US007326889B2

(12) United States Patent
Tosaka et al.

(10) Patent No.: US 7,326,889 B2
(45) Date of Patent: Feb. 5, 2008

(54) PTC ELEMENT AND PRODUCTION PROCESS THEREOF

(75) Inventors: Hisanao Tosaka, Tokyo (JP); Tokuhiko Handa, Tokyo (JP); Hirokazu Satoh, Tokyo (JP); Tsutomu Hatakeyama, Tokyo (JP)

(73) Assignee: TDK Corporation, Tokyo (JP)

( * ) Notice: Subject to any disclaimer, the term of this patent is extended or adjusted under 35 U.S.C. 154(b) by 0 days.

(21) Appl. No.: 11/521,543

(22) Filed: Sep. 15, 2006

(65) Prior Publication Data

US 2007/0069848 A1 Mar. 29, 2007

(30) Foreign Application Priority Data

Sep. 20, 2005 (JP) ..... P2005-272306

(51) Int. Cl.
*H05B 3/10* (2006.01)
*H01C 7/13* (2006.01)

(52) U.S. Cl. ..... 219/553; 338/22 R; 338/225 D; 338/309; 338/312; 338/314; 338/322; 338/324; 338/327; 338/328; 427/102; 427/103

(58) Field of Classification Search ..... 338/22 R, 338/225 D, 309, 312, 314, 322, 324, 327–8; 219/553; 427/102–3
See application file for complete search history.

(56) References Cited

FOREIGN PATENT DOCUMENTS

| | | |
|---|---|---|
| JP | A-01-189153 | 9/1989 |
| JP | A-04-007802 | 1/1992 |
| JP | B2 5-9921 | 2/1993 |
| JP | A-10-200027 | 7/1998 |
| JP | A-2002-083701 | 3/2002 |
| JP | A-2005-051107 | 2/2005 |

*Primary Examiner*—Shawntina Fuqua
(74) *Attorney, Agent, or Firm*—Oliff & Berridge, PLC

(57) ABSTRACT

A method of manufacturing a PTC element comprising a pair of lead terminals bonded together by thermocompression with a matrix held therebetween comprises a matrix preparing step of preparing a matrix constructed by dispersing a conductive filler into a crystalline polymer; a terminal preparing step of preparing a pair of lead terminals holding the matrix therebetween, a surface of each lead terminal facing the matrix being formed with a plurality of anchor protrusions separated from each other; a flattening step of flattening the anchor protrusions formed in respective non-overlapping areas in the pair of lead terminals kept from overlapping the matrix; and a thermocompression bonding step of holding the matrix between respective overlapping areas in the pair of lead terminals overlapping the matrix, and securing the pair of lead terminals and the matrix together by thermocompression bonding.

4 Claims, 8 Drawing Sheets

PTC ELEMENT AND PRODUCTION PROCESS THEREOF

BACKGROUND OF THE INVENTION

1. Field of the Invention

The present invention relates to a PTC (Positive Temperature Coefficient) element and a method of manufacturing the same.

2. Related Background Art

PTC elements have been known as elements for protecting circuit elements against overcurrents. The PTC elements are elements which drastically increase the positive temperature coefficient of their resistance value when reaching a specific temperature region. Known as one of such PTC elements is one disclosed in Patent Document 1 (Japanese Patent Publication No. HEI 5-9921).

SUMMARY OF THE INVENTION

In the PTC element disclosed in the above-mentioned Patent Document 1, a matrix having a positive resistance-temperature characteristic is constructed by a polymer and a conductive powder dispersed into the polymer, whereas a metal sheet having a roughened surface is bonded to the front face of the matrix such that the roughened surface comes into contact with the front face of the matrix, so as to be used as a terminal electrode. The surface in contact with the front face of the matrix is thus roughened in order to improve the bonding strength between the matrix and the metal sheet.

When the whole surface coming into contact with the front face of the matrix is roughened as in the PTC element disclosed in the above-mentioned Patent Document 1, however, the bonding strength may not fully be secured if the metal sheet acting as a terminal electrode is bonded to a connecting terminal such as external terminal by welding or soldering.

Therefore, it is an object of the present invention to provide a PTC element and a method of manufacturing the same which can improve the bonding strength when bonding a lead terminal extending from a matrix to another terminal.

The method of manufacturing a PTC element in accordance with the present invention is a method of manufacturing a PTC element comprising a pair of lead terminals bonded together by thermocompression with a matrix held therebetween, the method comprising a matrix preparing step of preparing a matrix constructed by dispersing a conductive filler into a crystalline polymer; a terminal preparing step of preparing a pair of lead terminals holding the matrix therebetween, a surface of each lead terminal facing the matrix being formed with a plurality of anchor protrusions separated from each other; a flattening step of flattening the anchor protrusions formed in respective nonoverlapping areas in the pair of lead terminals kept from overlapping the matrix; and a thermocompression bonding step of holding the matrix between respective overlapping areas in the pair of lead terminals overlapping the matrix, and securing the pair of lead terminals and the matrix together by thermocompression bonding.

In the present invention, the matrix is held between lead terminals having flattened the anchor protrusions formed in their nonoverlapping areas, and the lead terminals and the matrix are secured together by thermocompression bonding. Therefore, even when the matrix flows out to the nonoverlapping areas, for example, thus flowed-out part can easily be removed. Hence, the nonoverlapping areas are flattened without substantially leaving the matrix, whereby the lead terminals can favorably be bonded to other terminals.

Preferably, in the method of manufacturing a PTC element in accordance with the present invention, the anchor protrusions formed in the nonoverlapping areas are flattened by crushing in the flattening step. Crushing the anchor protrusions can flatten the nonoverlapping areas without generating unnecessary remnants.

The PTC element in accordance with the present invention is a PTC element comprising a matrix constructed by dispersing a conductive filler into a crystalline polymer, and a pair of lead terminals bonded together by thermocompression with the matrix held therebetween; wherein each of the pair of lead terminals has an overlapping area overlapping the matrix and a nonoverlapping area kept from overlapping the matrix; wherein the overlapping area in each of the pair of lead terminals is formed with an anchor protrusion having a larger diameter part and a smaller diameter part on a side closer to a root than is the larger diameter part; and wherein the anchor protrusion is flattened by crushing in the nonoverlapping area in each of the pair of lead terminals.

The present invention can easily flatten nonoverlapping parts of the lead terminals kept from overlapping the matrix, and thus can provide a PTC element whose nonoverlapping parts leave no matrix. This can improve the bonding strength at the time of bonding the nonoverlapping parts to other terminals.

Preferably, in the present invention, the overlapping area has a thickness of 60 to 140 μm, the nonoverlapping area has a thickness of 50 to 120 μm, and the anchor protrusion has an average height of 5 to 40 μm. When the thickness of the overlapping area is greater than 140 μm, the lead terminals become so thick that the thermal compression bonding between the matrix and lead terminals may become insufficient, thereby weakening the connecting strength between the matrix and lead terminals. Therefore, in view of the flattening, it will be preferred if the nonoverlapping area has a thickness of 120 μm or less. When the thickness of the nonoverlapping area is less than 50 μm, the strength of the lead terminals themselves decreases. Therefore, in view of the flattening of the nonoverlapping areas, it will be preferred if the overlapping area has a thickness of at least 60 μm. When the average height of the anchor protrusion is less than 5 μm, the anchor effect between the matrix and lead terminals cannot fully be exhibited, whereby the connecting strength between the matrix and lead terminals becomes weaker. When the average height of the anchor protrusion is greater than 40 μm, the strength of the anchor protrusion itself decreases, whereby the anchor protrusion may drop out of the lead terminals at the time of thermocompression bonding to the matrix.

The above-mentioned present invention can flatten the respective nonoverlapping areas in a pair of lead terminals without leaving the matrix there, and thus can favorably bond the lead terminals to other terminals. This can improve the bonding strength when bonding lead terminals extending from the matrix to other terminals.

DESCRIPTION OF THE PREFERRED EMBODIMENTS

The findings of the present invention will easily be understood in view of the following detailed description with reference to the accompanying drawings which are given by way of illustration only. Embodiments of the present invention will now be explained with reference to the accompanying drawings. When possible, the same parts will be referred to with the same numerals without repeating their overlapping descriptions.

Figure 1:
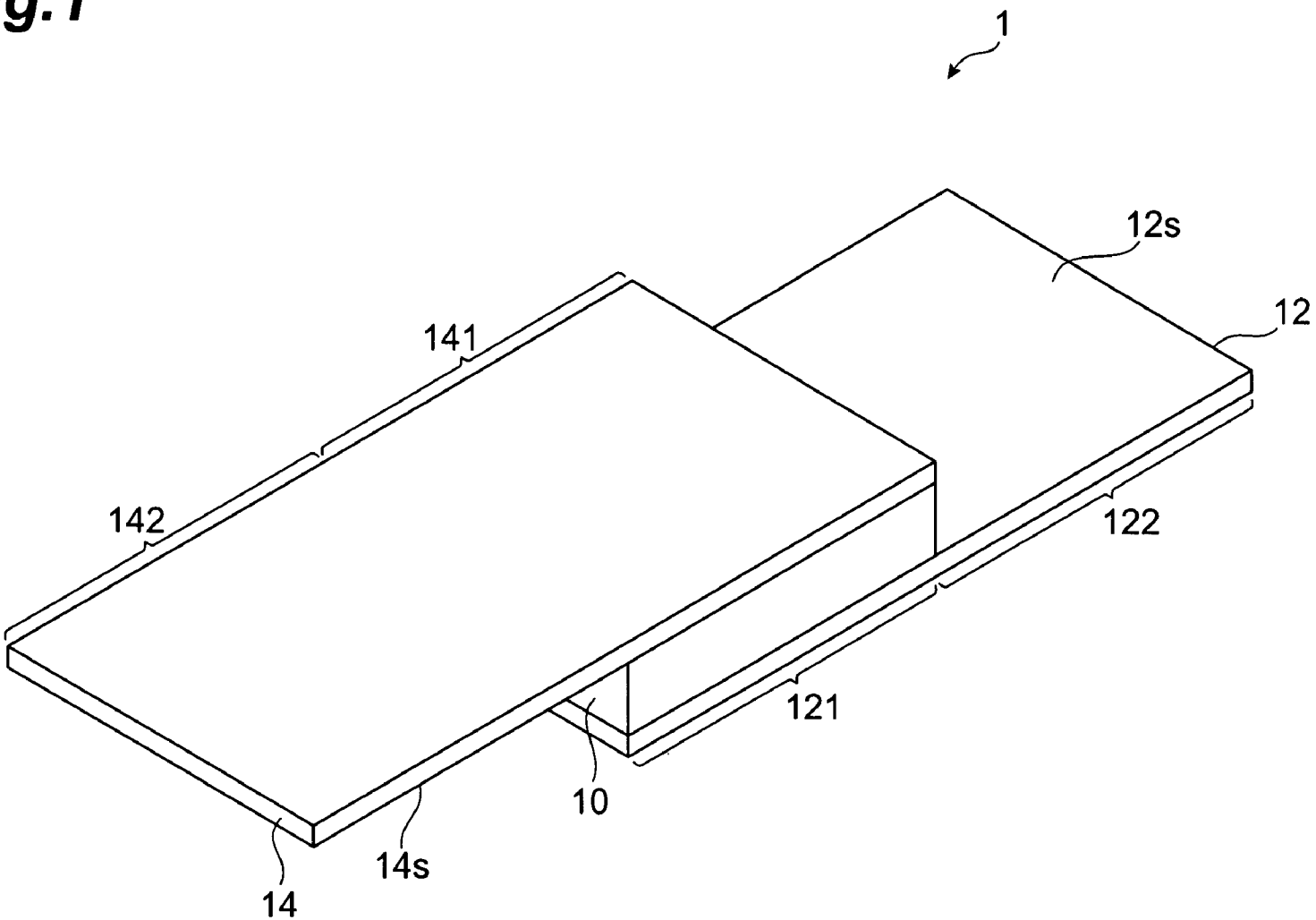
FIG. 1 is a perspective view showing the PTC element in accordance with an embodiment of the present invention.

A PTC element which is an embodiment of the present invention will be explained with reference to FIG. 1. FIG. 1 is a perspective view of a PTC element 1. The PTC element 1 is a polymer PTC element comprising a pair of terminal electrodes 12, 14 (lead terminals) and a matrix 10.

The pair of terminal electrodes 12, 14 are made of Ni or an Ni alloy, while having a thickness of about 0.1 mm. The pair of terminal electrodes 12, 14 are arranged such that they partly overlap each other. The matrix 10 is arranged between their opposing parts, whereby the pair of terminal electrodes 12, 14 hold the matrix 10 therebetween by their respective surfaces 12*s*, 14*s*. Therefore, the pair of terminal electrodes 12, 14 are formed with overlapping areas 121, 141 which overlap the matrix 10 and nonoverlapping areas 122, 142 which do not overlap the matrix 10.

The matrix 10 is formed by dispersing a conductive filler into a crystalline polymer resin. An Ni powder and a polyethylene resin which is a thermoplastic resin are preferably used as the conductive filler and the crystalline polymer resin, respectively. The matrix 10 is bonded under heat and pressure to the pair of terminal electrodes 12, 14.

Figure 2:
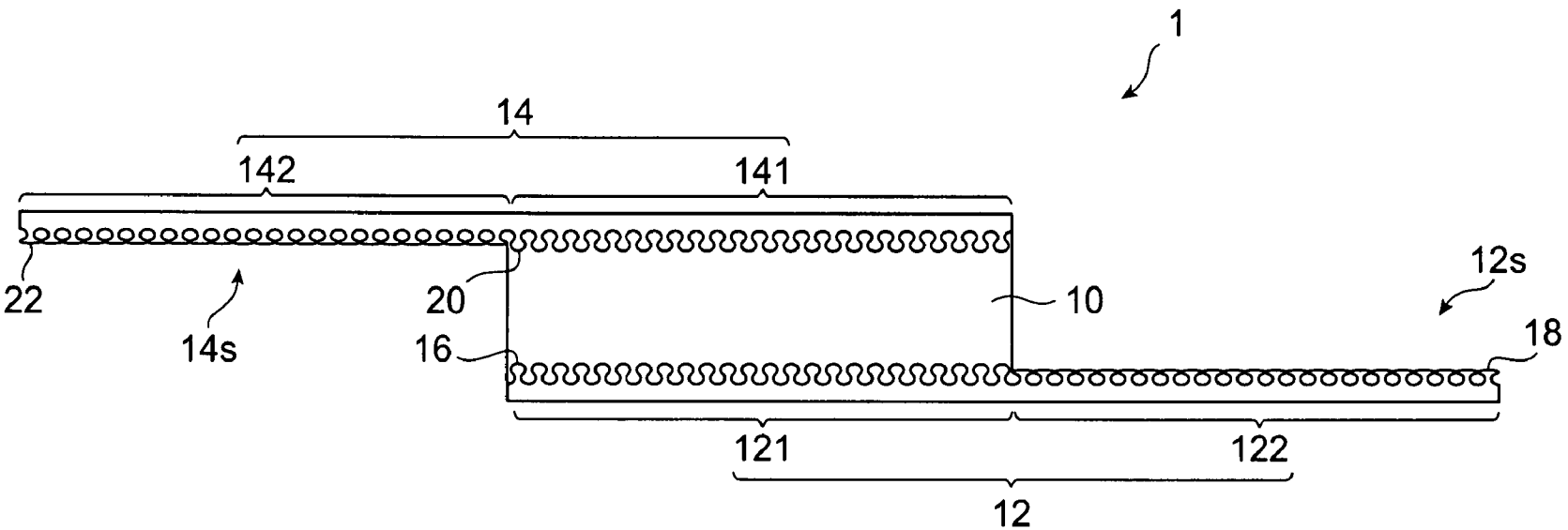
FIG. 2 is a plan view of the PTC element in accordance with the embodiment.

FIG. 2 is a side view of the PTC element 1 shown in FIG. 1. As shown in FIG. 2, the surfaces 12*s*, 14*s* of the terminal electrodes 12, 14 holding the matrix 10 therebetween are formed with a plurality of anchor protrusions 16, 20 and a plurality of flattened protrusions 18, 22. The anchor protrusions 16, 20 are formed in the overlapping areas 121, 141, whereas the flattened protrusions 18, 22 are formed in the nonoverlapping areas 122, 142. For the sake of explanation, the anchor protrusions 16, 20 and flattened protrusions 18, 22 are illustrated relatively greater in FIG. 2. The actual anchor protrusions 16, 20 and flattened protrusions 18, 22 are minute protrusions having a size which is hard to recognize by eyes. The same holds in drawings which will be used in the following explanations.

Figure 3:
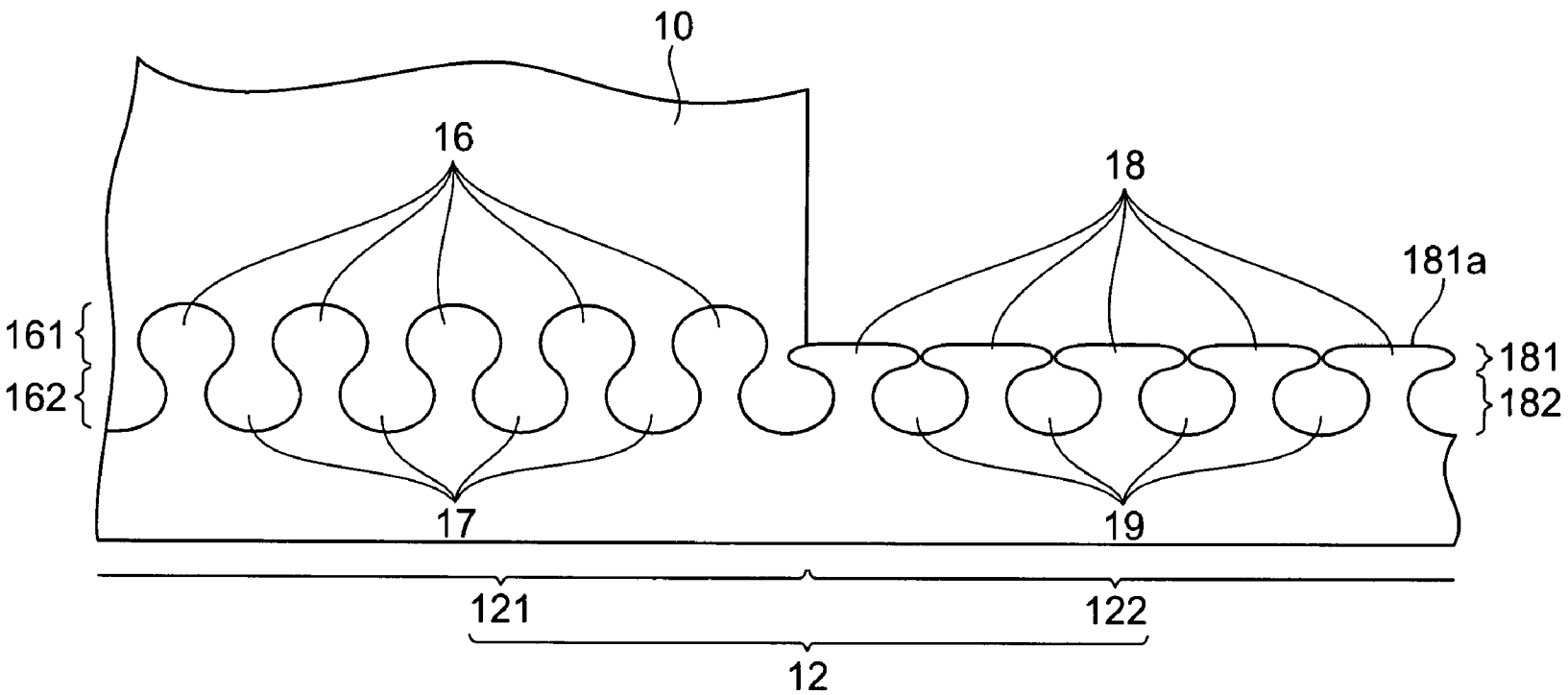
FIG. 3 is an enlarged view of a part of FIG. 2.

FIG. 3 shows an enlarged side view of the terminal electrode 12 shown in FIG. 2. As shown in FIG. 3, each of the plurality of anchor protrusions 16 formed in the overlapping area 121 has a larger diameter part 161 and a smaller diameter part 162. The larger diameter part 161 is provided on the leading end side in the direction along which the anchor protrusion 16 extends from the terminal electrode 12, and is formed such that its outer periphery taken normal to this direction is greater than that of the smaller diameter part 162. The smaller diameter part 162 is provided on the side closer to the root of the anchor protrusion 16 than is the larger diameter part 161. The forms of the larger diameter parts 161 and smaller diameter parts 162 may vary among the anchor protrusions 16. The larger diameter parts 161 and smaller diameter parts 162 may also have irregular outer peripheral forms instead of regular forms such as circles and ellipses.

The adjacent anchor protrusions 16 are arranged such as to be separated from each other. Therefore, the matrix 10 enters depressions 17 which are formed between the anchor protrusions 16, whereby the terminal electrode 12 and the matrix 10 are secured together. When the terminal electrode 12 and the matrix 10 are secured together without forming the anchor protrusions 16, the terminal electrode 12 is secured to the matrix 10 insufficiently, whereby the connecting strength between the matrix 10 and the terminal electrode 12 becomes extremely weak.

As shown in FIG. 3, each of the plurality of flattened protrusions 18 formed in the nonoverlapping area 122 has a larger diameter part 181 and a smaller diameter part 182. The larger diameter part 181 is provided on the leading end side in the direction along which the flattened protrusion 18 extends from the terminal electrode 12, and is formed such that its outer periphery taken normal to this direction is greater than that of the smaller diameter part 182. The leading end of the larger diameter part 181 is formed with a flat surface 181*a*. The smaller diameter part 182 is provided on the side closer to the root of the flattened protrusion 18 than is the larger diameter part 181. The forms of the larger diameter parts 181 and smaller diameter parts 182 may vary among the flattened protrusions 18. The larger diameter parts 181 and smaller diameter parts 182 may also have irregular outer peripheral forms instead of regular forms such as circles and ellipses.

The adjacent flattened protrusions 18 are arranged in contact with each other. The flattened surfaces 181*a* of the flattened protrusions 18 continue with each other, thereby forming a substantially flat surface. Therefore, the matrix 10 does not substantially enter depressions 19 formed between the flattened protrusions 18. Nevertheless, the flattened protrusions 18 are not completely in contact with each other, but may be separated from each other to such an extent that the bonding strength at the time of bonding the terminal electrodes 12, 14 to other terminals is not substantially affected thereby.

Though a substantially flat surface is made by forming the flattened protrusions 18 in contact with each other in the nonoverlapping areas 122, 142 in this embodiment, the embodiment is not limited to the one mentioned above as long as a substantially flat surface can be formed thereby. For example, the nonoverlapping areas 122, 142 may be flattened by cutting or grinding.

Figure 4:
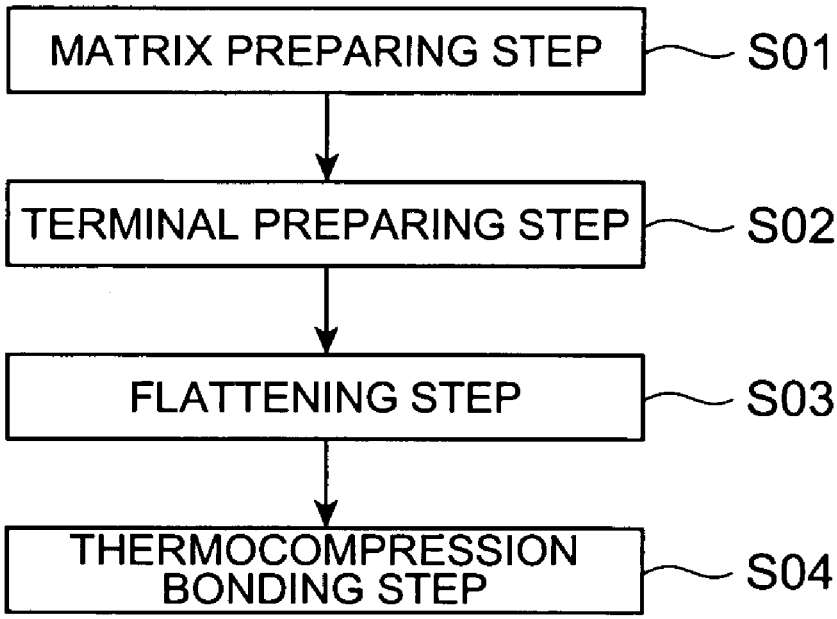
FIG. 4 is a view showing a procedure of a method of manufacturing the PTC element in accordance with the embodiment.

A method of manufacturing the above-mentioned PTC element 1 will now be explained mainly with reference to FIG. 4, and FIGS. 5 to 8 when necessary. FIG. 4 is a view showing a procedure of the method of manufacturing the PTC element 1 in accordance with this embodiment. FIGS. 5 to 8 are views showing the states of the terminal electrode 12 and matrix 10 under magnification in respective steps of the manufacturing method. As shown in FIG. 4, the method of manufacturing the PTC element 1 comprises a matrix preparing step (step S03), a terminal preparing step (step S02), a flattening step (step S03), and a thermocompression bonding step (step S04).

In the matrix preparing step (step S03), a matrix material to become the matrix 10 (see FIGS. 1 to 3) is made and prepared. First, an Ni powder to become a conductive filler and polyethylene to become a matrix resin are kneaded, so as to form a block. This block is pressed into a disk, which is then cut, so as to yield a matrix material.

Figure 5:
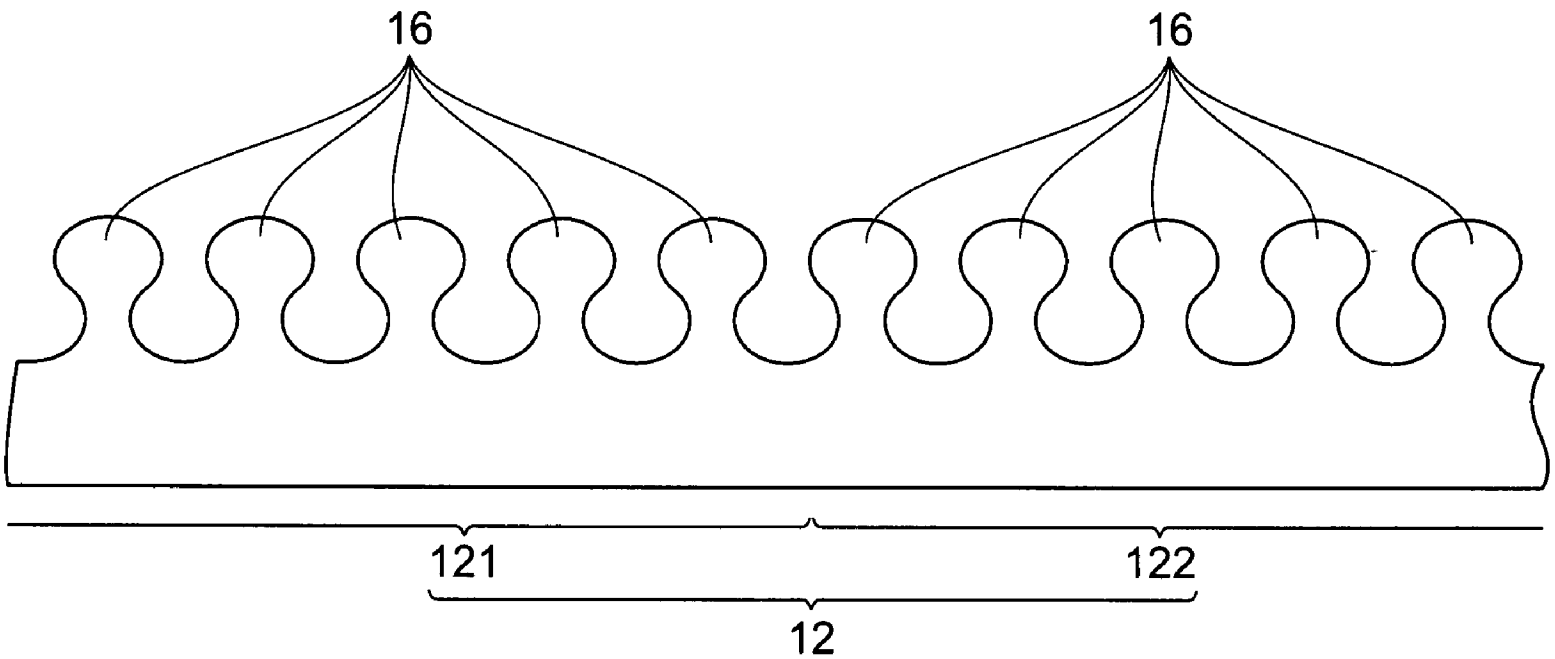
FIG. 5 is a view for enhancing the explanation of the manufacturing method whose procedure is shown in FIG. 4.

In the subsequent terminal preparing step (step S02), metal sheets to become the terminal electrodes 12, 14 (see FIGS. 1 to 3) are made and prepared. The surfaces 12*s*, 14*s* by which the terminal electrodes 12, 14 (see FIGS. 1 to 3) hold the matrix 10 (see FIGS. 1 to 3) therebetween are formed with the anchor protrusions 16, 20 (see FIGS. 1 to 3). The anchor protrusions 16, 20 are constructed by continuously forming the burl-shaped protrusions mentioned above. In the terminal electrode 12, for example, the anchor protrusions 16 are formed in both of its overlapping area 121 and nonoverlapping area 122 as shown in FIG. 5. The same holds in the terminal electrode 14, which is not depicted.

Figure 6:
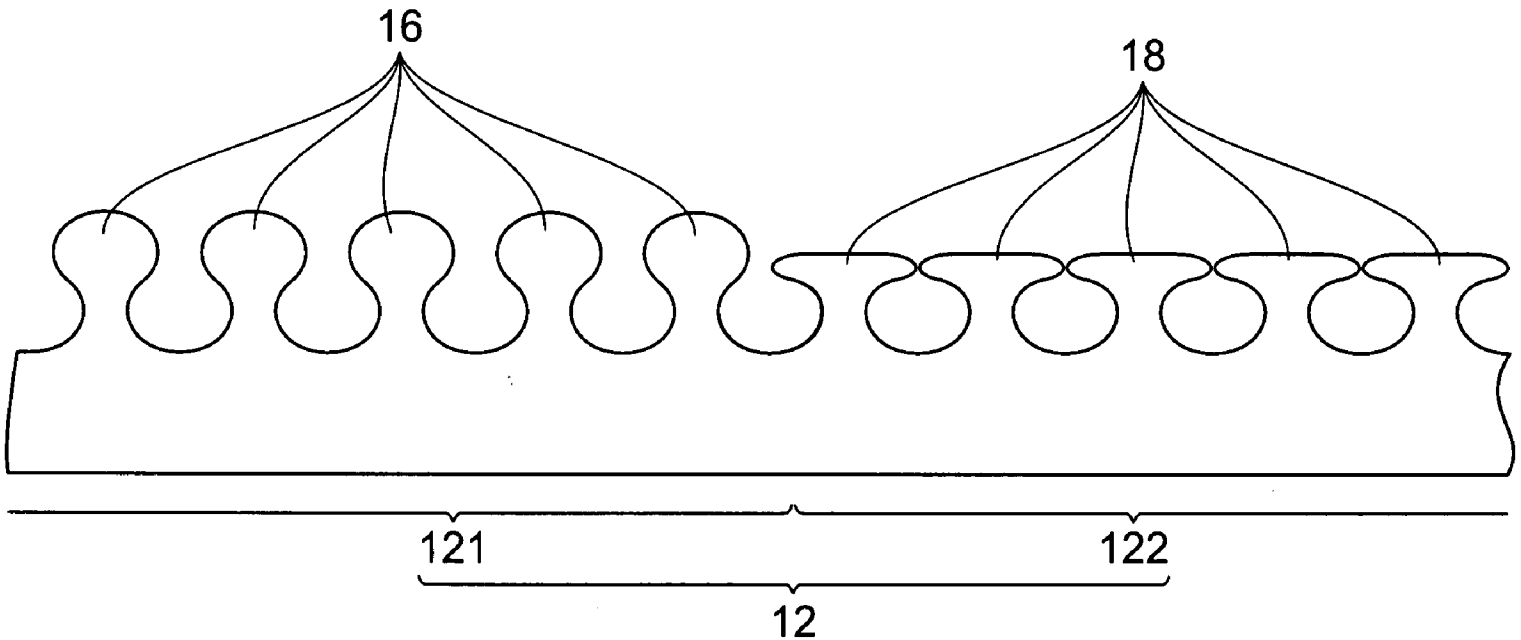
FIG. 6 is a view for enhancing the explanation of the manufacturing method whose procedure is shown in FIG. 4.

Returning to FIG. 4, in the flattening step (step S03), the anchor protrusions 16, 20 formed in the nonoverlapping areas 122, 142 (see FIGS. 1 to 3) are flattened by crushing. In the terminal electrode 12, for example, the anchor protrusions 16 formed in the nonoverlapping area 122 are crushed by a press, so as to yield the flattened protrusions 18 as shown in FIG. 6. The press moving amount in this case is 10 to 35 μm, more preferably 10 to 15 μm.

As mentioned above, the flattened protrusions 18 come into contact with each other, so as to be substantially flattened. In terms of the thickness of the terminal electrode, the average thickness of the nonoverlapping area 122 formed with the flattened protrusions 18 is smaller than that of the overlapping area 121 formed with the anchor protrusions 16. The average thickness can be determined from the mass and specific gravity of a sample punched out by a predetermined area.

In this embodiment, for example, it will be preferred if the thickness after flattening is 60 to 140 μm, in the overlapping areas 121, 141, and 50 to 120 μm, in the nonoverlapping areas 122, 142. In this case, the average height of the anchor protrusions 16, 20 is 5 to 40 μm. More preferably, the thickness after flattening is 95 to 100 μm, in the overlapping areas 121, 141, and 80 to 90 μm, in the nonoverlapping areas 122, 142. In this case, the average height of the anchor protrusions 16, 20 is 5 to 20 μm.

When the thickness of the overlapping areas 121, 141 is greater than 140 μm, the terminal electrodes 12, 14 become so thick that the thermocompression bonding between the matrix 10 and terminal electrodes 12, 14 may become insufficient, thereby weakening the connecting strength between the matrix 10 and terminal electrodes 12, 14. Therefore, in view of the flattening, it will be preferred if the nonoverlapping areas 122, 142 have a thickness of 120 μm, or less.

When the thickness of the nonoverlapping areas 122, 142 is less than 50 μm, the terminal electrodes 12, 14 themselves decrease their strength, thereby bending in the nonoverlapping areas 122, 142 and so forth, thus complicating their handling during and after their manufacturing process. Therefore, in view of the flattening of the nonoverlapping areas 122, 142, it will be preferred if the overlapping areas 121, 141 have a thickness of at least 60 μm.

When the average height of the anchor protrusions 16, 20 is less than 5 μm, the anchor effect between the matrix 10 and terminal electrodes 12, 14 cannot fully be exhibited, whereby the connecting strength between the matrix 10 and terminal electrodes 12, 14 becomes weaker. When the average height of the anchor protrusions 16, 20 is greater than 40 μm, the strength of the anchor protrusions 16, 20 themselves decreases, whereby the anchor protrusions 16, 20 may drop out of the terminal electrodes 12, 14 at the time of thermocompression bonding to the matrix 10.

Returning to FIG. 4, in the thermocompression bonding step (step S04), the pair of terminal electrodes 12, 14 (see FIGS. 1 to 3) hold the matrix material (matrix) therebetween by their respective overlapping areas 121, 141 (see FIGS. 1 to 3), and the pair of terminal electrodes 12, 14 (see FIGS. 1 to 3) and the matrix 10 (see FIGS. 1 to 3) are secured together by thermocompression bonding.

Figure 7:
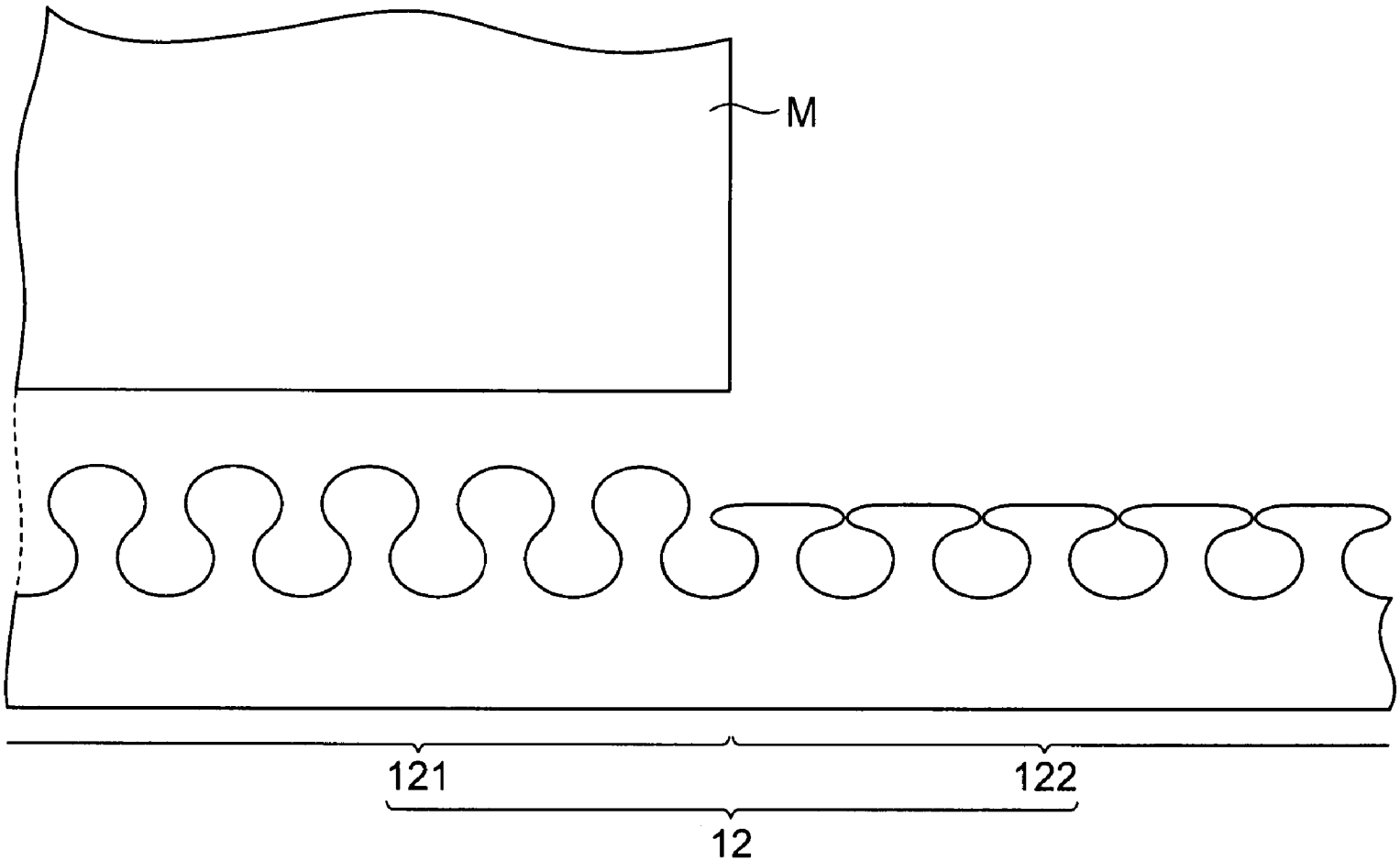
FIG. 7 is a view for enhancing the explanation of the manufacturing method whose procedure is shown in FIG. 4.
Figure 8:
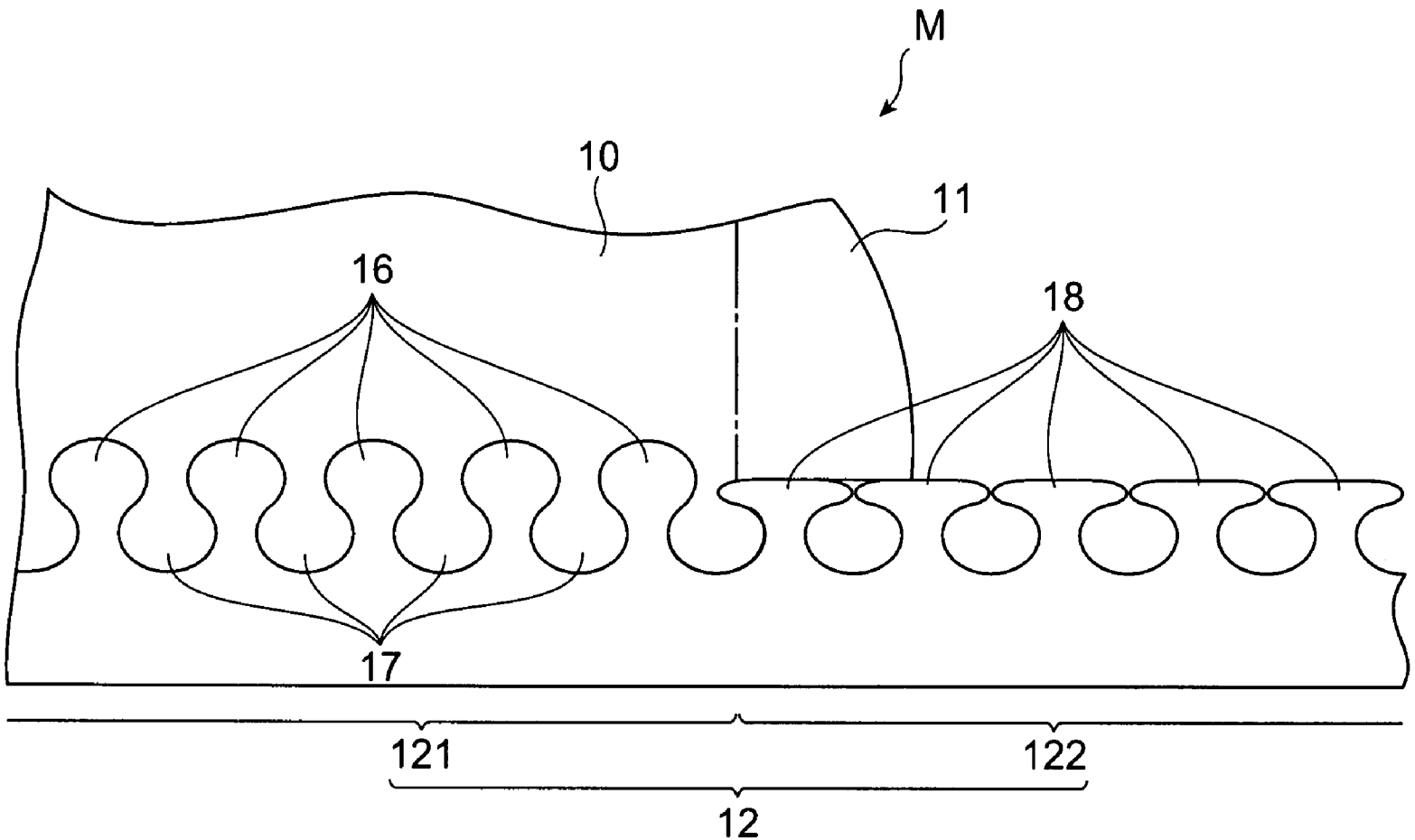
FIG. 8 is a view for enhancing the explanation of the manufacturing method whose procedure is shown in FIG. 4.

More specifically, as shown in FIG. 7, the terminal electrodes 12 and 14 (not depicted in FIG. 7) flattened in step S03 hold therebetween the matrix material M prepared by step S03. At that time, the matrix material M is arranged so as to be held between the overlapping area 121 of the terminal electrode 12 and the overlapping area (not depicted in FIG. 7) of the terminal electrode 14. Subsequently, the matrix material M is compressed by the terminal electrodes 12 and 14 while being heated, whereby the state shown in FIG. 8 is obtained. Since the matrix material M flows out from the overlapping area 121 to the nonoverlapping area 122 as shown in FIG. 8, thus flowed-out part 11 is removed. Pressing may be effected either during or after the heating.

The above-mentioned method can yield the PTC element 1 in accordance with this embodiment. The anchor protrusions 16, 20 are flattened by crushing in the flattening step, but may be flattened by cutting or grinding as well.

In this embodiment, the matrix material M (matrix 10) is held between the terminal electrodes having flattened the anchor protrusions 16, 20 formed in the nonoverlapping areas 122, 142, and the terminal electrodes 12, 14 and the matrix 10 are secured together by thermocompression bonding. Therefore, even when the matrix material M (matrix 10) flows out to the nonoverlapping areas 122, 142, for example, thus flowed-out part can be removed easily. Hence, the nonoverlapping areas 122, 142 are flattened without leaving the matrix material M (matrix 10), whereby the terminal electrodes 12, 14 can favorably be bonded to other terminals by soldering or welding (spot welding in particular).

What is claimed is:

1. A method of manufacturing a PTC element comprising a pair of lead terminals bonded together by thermocompression with a matrix held therebetween, the method comprising:

a matrix preparing step of preparing a matrix constructed by dispersing a conductive filler into a crystalline polymer;

a terminal preparing step of preparing a pair of lead terminals holding the matrix therebetween, a surface of each lead terminal facing the matrix being formed with a plurality of anchor protrusions separated from each other;

a flattening step of flattening the anchor protrusions formed in respective nonoverlapping areas in the pair of lead terminals kept from overlapping the matrix; and a thermocompression bonding step of holding the matrix between respective overlapping areas in the pair of lead terminals overlapping the matrix, and securing the pair of lead terminals and the matrix together by thermocompression bonding.

2. A method according to claim 1, wherein the anchor protrusions formed in the nonoverlapping areas are flattened by crushing in the flattening step.

3. A PTC element comprising a matrix constructed by dispersing a conductive filler into a crystalline polymer, and a pair of lead terminals bonded together by thermocompression with the matrix held therebetween;

wherein each of the pair of lead terminals has an overlapping area overlapping the matrix and a nonoverlapping area kept from overlapping the matrix;

wherein the overlapping area in each of the pair of lead terminals is formed with an anchor protrusion having a larger diameter part and a smaller diameter part on a side closer to a root than is the larger diameter part; and wherein the anchor protrusion is flattened by crushing in the nonoverlapping area in each of the pair of lead terminals.

4. A PTC element according to claim 3, wherein the overlapping area has a thickness of 60 to 140 μm, the nonoverlapping area has a thickness of 50 to 120 μm, and the anchor protrusion has an average height of 5 to 40 μm.

* * * * *